United States Patent [19]

Havercroft

[11] Patent Number: 4,776,172

[45] Date of Patent: Oct. 11, 1988

[54] POROUS SHEET STRUCTURE FOR A COMBUSTION CHAMBER

[75] Inventor: Peter Havercroft, Derby, England

[73] Assignee: Rolls-Royce plc, London, England

[21] Appl. No.: 66,933

[22] Filed: Jun. 26, 1987

[30] Foreign Application Priority Data

Jul. 18, 1986 [GB] United Kingdom ..... 8617624

[51] Int. Cl.[4] ..... F02C 1/00

[52] U.S. Cl. ..... 60/754; 416/97 A

[58] Field of Search ..... 60/754, 755, 756, 757; 416/90 R, 95, 97 A; 415/115; 428/137, 138, 573, 586, 594

[56] References Cited

U.S. PATENT DOCUMENTS

| | | | |
|---|---|---|---|
| 3,584,972 | 7/1971 | Bratkovich et al. | 60/754 |
| 4,004,056 | 1/1977 | Carroll | 428/138 |
| 4,168,348 | 9/1979 | Bhangu et al. | 416/90 R |
| 4,269,032 | 5/1981 | Meginnis et al. | 428/138 |
| 4,292,376 | 9/1981 | Hustler | 60/755 |
| 4,296,606 | 10/1981 | Reider | 60/754 |
| 4,302,940 | 12/1981 | Meginnis | 60/754 |
| 4,312,186 | 1/1982 | Reider | 60/754 |

*Primary Examiner*—Louis J. Casaregola
*Assistant Examiner*—Timothy S. Thorpe
*Attorney, Agent, or Firm*—Cushman, Darby & Cushman

[57] ABSTRACT

Known porous laminates of the kind wherein ambient atmosphere each side of the laminate is connected via holes and passageways, the latter lying within the laminate thickness in planes parallel with the faying faces, suffer from airflow energy loss which arises from the changes in direction undergone by the airflow while in transit from one side of the laminate to the other side thereof. The invention provides extra holes on the high pressure side of the laminate, over those points in the passages wherein the greatest change in direction of flow occurs, so as to re-energize the airflow which has reached those points via the relevant holes of the known arrangement.

4 Claims, 1 Drawing Sheet

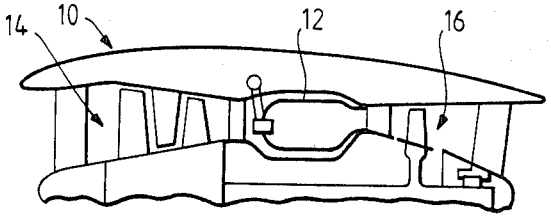
Fig. 1.
Fig. 2.
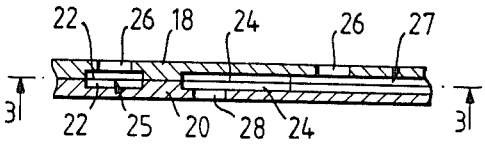
Fig. 3.
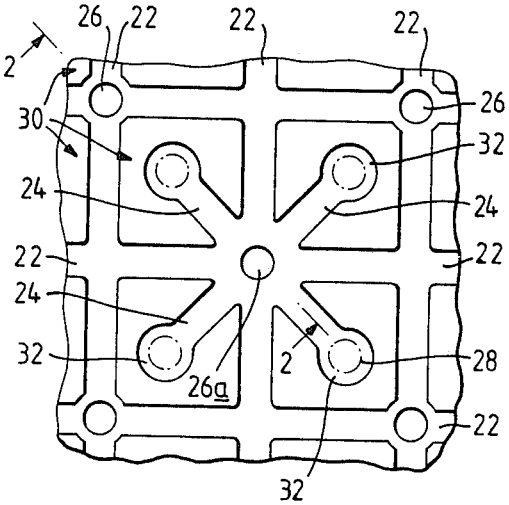
Fig. 4.
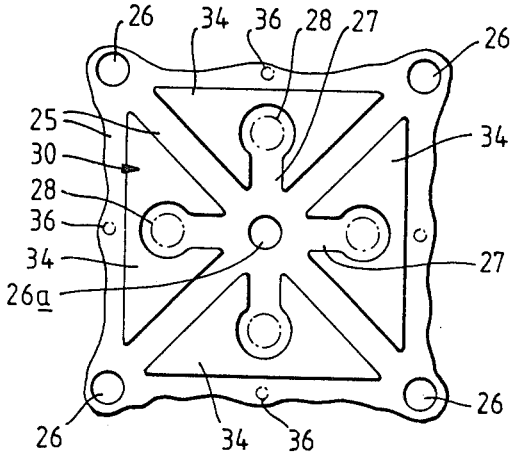

POROUS SHEET STRUCTURE FOR A COMBUSTION CHAMBER

This invention relates to a porous structure of the kind which is constructed from a plurality of sheets of metal i.e. a laminated structure.

The porosity is achieved by forming intersecting channels in a or each faying face of the laminate and forming first holes which break into the channels from one external side of the laminate and forming further holes which break into the channels from the other external side of the laminate. The first and further holes are offset relative to each other and thus a tortuous path is provided across the thickness of the laminate.

When such structures as those described hereinbefore are used in the manufacture of combustion chambers for gas turbine engines, whether they be of the kind known as gas turbine jet propulsion engines or the kind known as gas turbine ducted fan engines, common benefits accrue. Such benefits include the enabling of the use of the combustion chamber in a hotter environment, which in turn enables generation of more thrust. Further, during ground idle running of an engine, the combustion chambers of which include in their construction porous sheeting as described hereinbefore, a level of pollution is achieved which is compliant with officially acceptable levels.

Known patterns of channels and holes in a laminate, whilst providing the aforementioned benefits, nevertheless do so without actually achieving a magnitude of efficiency as regards maintenance of energy in the air flow through the tortuous paths. One main reason for loss of energy is the necessity for the air flow to be deflected through reverse angles i.e. angles greater than 90°, which results in the air flowing in a direction which has a component which is the reciprocal of the original direction. The energy derived from momentum is thus lost. The more slowly the air moves, the more quickly it becomes heat soaked and thus is unable to extract heat from the metal during the latter part of its movement to an exit hole.

The present invention seeks to provide a porous structure having known tortuous paths through its thickness but with improved airflow energy retention.

According to the present invention a porous laminate comprises a pair of sheets the faying face of at least one of which has a pattern of straight, main channels therein which intersect so as to define rectangular bosses, each reactangular boss being sub-divided into smaller bosses by further intersecting main channels and wherein each smaller boss has a channel therein, one end of which communicates with the intersection of the sub dividing channels and the other end of which is closed, first holes in one side of the laminate which directly communicate with the main channels at their intersections, second holes in said one side of the laminate which directly communicate with the sub-dividing channels at their intersections and third holes in the other side of the laminate and which directly communicate with the interior of the closed ended channels at positions adjacent their closed ends.

Preferably the faying face of each sheet of the laminate has complementary main, sub dividing and diagonal channels formed therein so that on assembly thereof, there results enclosed passageways for airflow across the thickness of the laminate, said enclosed passageways following a tortuous path through the laminate in plane which are parallel with their faying faces.

The two sheets may be joined by a diffusion bonding process.

The invention further includes a combustion chamber suitable for use in a gas turbine jet propulsion engine and/or a gas turbine ducted fan engine and constructed, at least in part, from a laminate of the kind embraced by the present invention.

The invention will now be described, by way of example and with reference to the accompanying drawings in which:

FIG. 1 is a diagrammatic part view of a gas turbine engine incorporating a combustion chamber comprised of a porous sheet structure in accordance with the present invention, FIG. 2 is an enlarged part view of the porous sheet structure utilised in the construction of the combustion chamber of FIG. 1 and FIG. 3 is a developed view on line 3—3 in FIG. 2.

FIG. 4 is an alternative porous sheet structure which embodies the present invention.

Referring to FIG. 1. A gas turbine engine 10 has combustion equipment 12 situated between a compressor 14 and an expansion turbine 16 in known manner.

The combustion equipment 12 of the present example is an annular structure. It could however, consist of a number of tubular members spaced around and downstream of the exit of the compressor 14, again in known manner.

Referring now to FIG. 2. The combustion equipment 12 is constructed from a laminate consisting of two sheets 18 and 20 of heat resistant metal. The faying faces of the sheets have mirror image patterns of grooves 22 and 24 therein, so that when the sheets 18 and 20 are assembled together e.g. by diffusion bonding, closed channels 25 and 27 are formed, and their layout is more clearly seen in FIG. 3.

Still referring to FIG. 2, sheet 18 which is the outer one of the two sheets 18 and 20, has holes 26 and **26*a* therein which enable direct communication between compressed air flowing thereover and the closed channels 25 and 27. Sheet 20 has holes 28 therein which enable direct communication between the closed channels 27 and the interior of the combustion chamber 12** which is formed from the laminate.

Referring now to FIG. 3 which shows the faying face of sheet 18. The grooves 22 are straight and intersect normally to each other, and in so doing, form rectangular bosses 30. The grooves 24 are also straight and intersect normally to each other. The grooves 24 however, are arranged diagonally with respect to the bosses 30. A closed end 32 of each groove 24 is contained within each boss 30.

The position of the holes 28 relative to the holes 26 and which are in sheet 20 (not shown in FIG. 3) are indicated by chain dotted lines.

During operation of the gas turbine engine 10, compressed air flowing over the combustion equipment 12 has a higher static pressure than the expanding gases there within. Consequently a flow of air is established which enters the holes 26 and divides to flow along the channels 25 formed by grooves 22 and joins again at the intersections of the channels 27 which are formed by the grooves 24. The air immediately divides again to pass towards the closed ends of the channels 27 and so out of the holes 28 and into the combustion equipment interior. The second dividing of the flow involves a change in direction of more than 90°. This, plus the collision which occurs as the airflows converge from the channels 27 which are defined by opposing grooves 24, tends to slow the air and thus reduce its energy by an order of magnitude which in turn considerably reduces its cooling efficiency. In order to counter the effects described hereinbefore, further holes 26a are provided, one at each junction of the channels 25 and 27 which are defined by the grooves 22 and 24 respectively. The new supply impinges on the existing flow and re-energises it, thus raising the cooling efficiency.

Referring now to FIG. 4 in which like parts are given like numerals.

The square bosses 30 are sub-divided by the channels 25 such as to define triangular portions 34. The channels 27 are arranged so as to lie parallel with the sides of the bosses 30, and with the channels 25, converge at the centre thereof. Inlet holes 26 are provided adjacent each corner of each boss 30, at the intersection of the channels 25.

The energy boosting holes 26a are again provided at the convergence of the channels 25 and 27. Each channel 27 is closed at its extremity furthest from the point of convergence and has outlet holes 28 therein.

The arrangement depicted in FIG. 4 would have a drawback in that the inlet holes 26 at each corner of each boss 30, passes some air along the edges of each boss 30. Thus the air from each pair of holes 26 will meet intermediate the length of each boss edge and stagnate. In order to prevent this with its consequent hot spots, further holes 36 are provided at that meeting point. The holes 36 communicate with the interior of the combustion chamber 12 (FIG. 1) as do the holes 28. The holes 36 however, should be smaller than the holes 26 and 26a so as to ensure only sufficient continuity of flow across the thickness of the porous laminate to avoid the said stagnation, and to further ensure avoidance of starvation of air from the remainder of the channels 25 and 27.

The invention as described hereinbefore, has mirror image channels formed in both faying faces of the sheets. The channels could be formed in only one of the faying faces, provided that the relevant sheet was of sufficient thickness. A further alternative consists of producing the mirror image pattern in each faying face, but making the grooves shallow in that sheet which provides the interior surface of the combustion chamber, relative to the depth of the grooves in the other sheet. The material thickness at the bottom of the shallow grooves is thus greater and results in a reduced temperature gradient across the metal thickness.

I claim:

1. A porous laminate comprises a pair of metal sheets the faying faces of at least one of which has a pattern of straight main channels therein which intersect so as to define rectangular bosses, each rectangular boss being sub-divided into smaller bosses by further intersecting main channels and wherein each smaller boss has a channel therein, one end of which communicates with the intersection of the sub-dividing main channels and the other end of which is closed, first holes in one side of the laminate which directly communicate with the main channels at their intersections, second holes in said one side of the laminate which directly communicate with the sub-dividing channels at their intersections and third holes in the other side of the laminate and which directly communicate with the interior of the diagonal channels at positions adjacent their closed ends.

2. A porous laminate as claimed in claim 1 wherein the faying face of each sheet has said main, sub-dividing and diagonal channels therein, so that on assembly thereof there results enclosed passageways for airflow across the thickness of the laminate, said enclosed passageways following a tortuous path through the laminate in planes which are parallel with their faying faces.

3. A porous laminate as claimed in claim 1 wherein the sheets are diffusion bonded together.

4. A combustion chamber suitable for use in a gas turbine jet propulsion engine and/or a gas turbine ducted fan engine wherein the combustion chamber at least in part, is constructed from a porous laminate as claimed in claim 1.

* * * * *